United States Patent [19]

Berry et al.

[11] Patent Number: 4,516,879

[45] Date of Patent: May 14, 1985

[54] FOAM SLABS IN MINE TUNNEL STOPPINGS

[75] Inventors: James A. Berry; Morton Sherman, both of St. Petersburg, Fla.; John W. Stevenson, Birmingham, Ala.

[73] Assignee: The Celotex Corporation, Tampa, Fla.

[21] Appl. No.: 498,362

[22] Filed: May 26, 1983

[51] Int. Cl.[3] ..... F21F 1/14; F24F 7/00

[52] U.S. Cl. ..... 405/132; 52/396; 98/50; 405/150

[58] Field of Search ..... 405/150, 303, 132, 284–287, 405/272, 273; 98/50; 52/309, 396

[56] References Cited

U.S. PATENT DOCUMENTS

| | | | |
|---|---|---|---|
| 2,729,064 | 1/1956 | Kennedy et al. . | |
| 3,256,657 | 6/1966 | Phipps | 52/396 X |
| 3,355,849 | 12/1967 | Hancock | 52/396 |
| 3,410,098 | 11/1968 | Winberg . | |
| 3,478,480 | 11/1969 | Swenson | 52/396 |
| 3,636,852 | 1/1972 | Burges, Jr. | 98/50 |
| 3,750,411 | 8/1973 | Shimiza et al. . | |
| 3,805,466 | 4/1974 | Van Laar et al. | 52/396 X |
| 3,863,554 | 2/1975 | Boyd | 98/50 |
| 3,972,272 | 8/1976 | Bagby | 98/50 |
| 3,996,713 | 12/1976 | Haeussler | 52/309 |
| 4,096,702 | 6/1978 | Burton . | |
| 4,139,989 | 2/1979 | Jones | 405/147 |
| 4,180,352 | 12/1979 | Divers et al. | 405/303 |
| 4,195,850 | 4/1980 | Berger et al. | 277/12 |
| 4,199,158 | 4/1980 | de Munck | 277/205 |
| 4,282,802 | 8/1981 | Divers et al. | 98/50 |

OTHER PUBLICATIONS

Kawenski, E. M. et al., "An Evaluation of Stopping Construction", Mining Congress Journal, pp. 57–61, Sep. 1963.

Kawenski, E. M. et al., "Stoppings for Ventilating Coal Mines", U.S. Bureau of Mines, RI 6710, pp. 1–2.

B Bond Industries Price Schedule, Nov. 1981, Timko, R. J. et al., "Brushes Lessen Stopping Leaks", Coal Age, pp. 108–114, Apr. 1982.

*Primary Examiner*—Dennis L. Taylor

*Attorney, Agent, or Firm*—James W. Grace; Charles W. Vanecek

[57] ABSTRACT

A stopping for use in improving underground mine ventilation comprising an assembly of wall elements, said wall elements comprising:

(a) a plurality of rigid blocks, and (b) a plurality of compliant sealing members. The rigid blocks and compliant sealing members are combined in courses to form a wall which extends over substantially the entire cross section of a tunnel being stopped, the sealing members being interposed between and/or around the rigid blocks in a uniform or nonuniform arrangement throughout the extent of the wall so as to (i) accommodate convergence loads imposed on the wall, and (ii) form, together with the rigid blocks, a barrier against the flow of gas through the tunnel.

26 Claims, 2 Drawing Figures

FOAM SLABS IN MINE TUNNEL STOPPINGS

BACKGROUND OF THE INVENTION

1. Field of the Invention

This invention relates to mine stoppings for coal mines or the like to control the flow of air for mine ventilation.

2. Description of the Prior Art

Stopping devices are used to control and direct the flow of air through underground passageways and to seal off portions of a mine. The stoppings are often installed in mines so as to direct air flow to the working face and prevent loss of air flow through cross cuts and entries which are not being worked. In ventilating the mine, fresh air is delivered under pressure to the working face and often must travel a considerable distance between the mine opening and the face of the mine. If the stoppings separating the crosscuts and entries are not sufficiently air-tight, the losses will be such as to effectively reduce the velocity of the air at the mine face. It is not uncommon for a mine to lose more than half of its induced air through leaky stoppings and doors. Consequently, the dust and gases in the area being worked by the miners will not be effectively removed to the outside of the mine.

The construction and maintenance of mine stoppings is expensive and time consuming. Conventional stoppings consist of walls constructed of concrete block and cement, which are relatively difficult and costly to construct and maintain. For example, a typical coal mine stopping consists of about 160 concrete blocks, and at least one minimg car is usually required to transport construction materials significant distances down into the mine to erect one mine stopping. Furthermore, a substantial amount of time and manpower is also required to construct such a mine stopping since each of the concrete blocks have to be individually set in place and cemented.

The rigidity of a mine stopping of this type makes it susceptible to deformation by convergent ground movements or shock from explosve charges. Failure of the stopping is manifested by the formation of the aforementioned air leaks or, in the worst case, by a total collapse of the masonry structure, thereby requiring reconstruction of the stopping in the operational maintenance of the mine ventilation system. The elimination or reduction of stopping air leakage and of stopping failures is essential to the provision of a satisfactory ventilation efficiency in the mine, with resulting health and safety benefits to the miners.

OBJECTS OF THE INVENTION

It is therefore an object of the present invention to provide an improved mine stopping which will permit effective ventilation of the mine face.

It is another object of this invention to provide a mine stopping that is strong and durable, and can accommodate moderate movement in the mine without failing, thereby lengthening the useful life of the mine stopping.

It is still another object of this invention to provide a mine stopping which can be more quickly and easily installed in a mine tunnel than a conventional "all-masonry" stopping, and brings about a substantial reduction in the time and labor ordinarily required in constructing and maintaining conventional stoppings.

It is yet another object of the present invention to provide a stress-compliant and flame spread-resistant sealant material for incorporation at the perimeter of and between the brittle concrete blocks of a mine stopping to seal the stopping against the leakage of air and other gases with prolonged accommodation of convergence load conditions.

These and other objects and advantages of the present invention will become more apparent to those skilled in the art when the instant disclosure is read in conjunction with the accompanying drawings.

SUMMARY OF THE INVENTION

The above objects have been achieved in the mine stopping of the present invention wherein a stress-compliant, interfacial sealant member is incorporated into a customary rigid concrete block mine tunnel stopping, thereby significantly lengthening the service time integrity of the stopping against air leakage failure due to strata convergence loading. The interfacial complying sealant material, when suitably applied intermediately to horizontal and vertical joints of the concrete block field area to complement similarly compliant material at the top and bottom perimeters of the stopping, greatly improves the service time integrity by imparting a suitable stress compliance capability to a normally rigid non-compliant wall construction.

DESCRIPTION OF THE DRAWINGS

The invention will now be described with reference to the accompanying drawings in which.

DETAILED DESCRIPTION OF THE INVENTION

Figure 1:
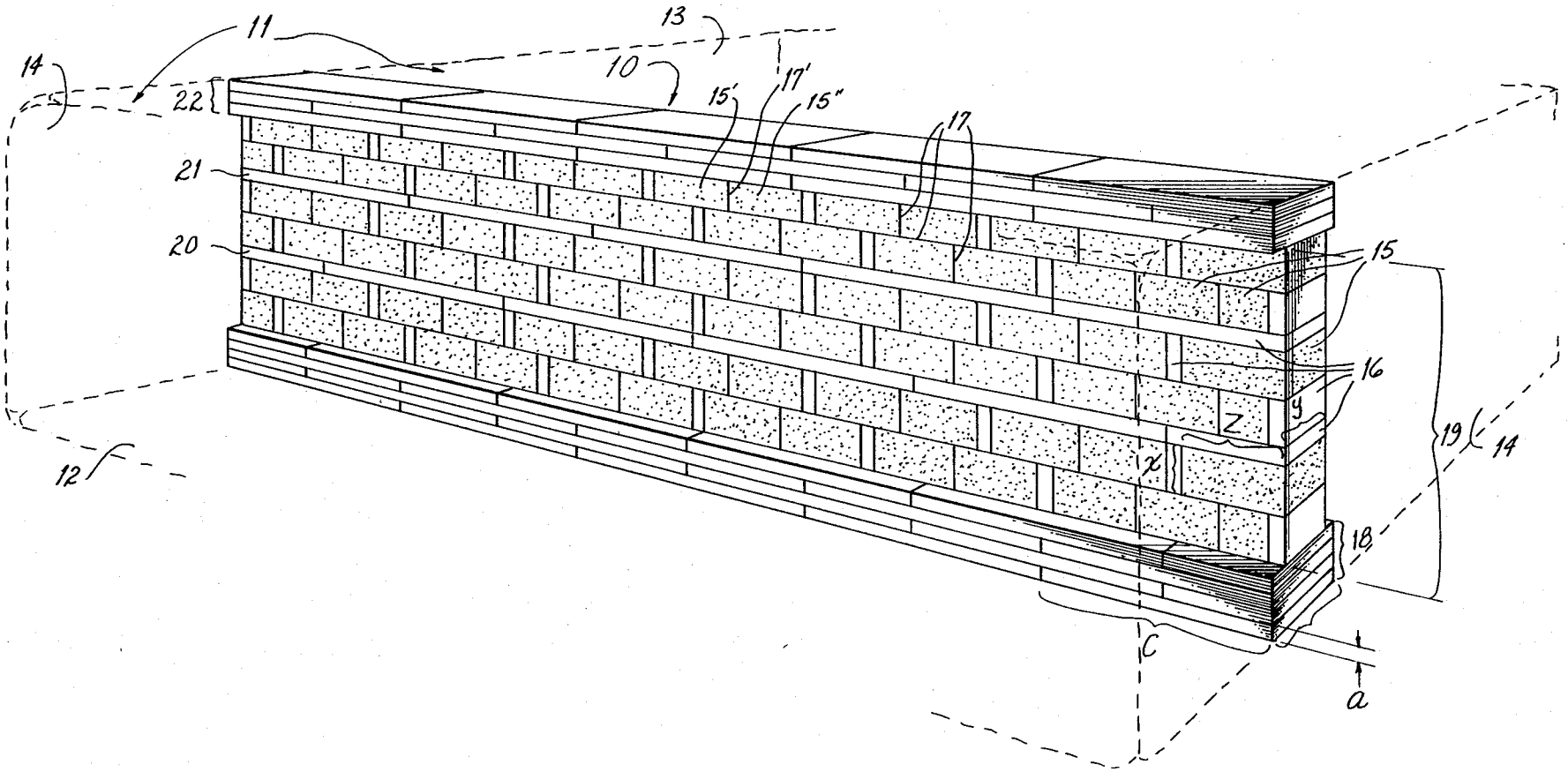
FIG. 1 is a perspective view illustrating a preferred embodiment of the stopping of the present invention.

Referring to FIG. 1 of the drawings, a mine stopping 10 of the invention is shown erected in a coal mine tunnel 11 having a floor 12, a ceiling 13 and side walls 14. The stopping extends across the entire cross section of the tunnel and closes the tunnel against passage of air and other gases. Mine stopping 10 comprises a composite structure made up of rigid blocks 15 with stress-compliant material 16 interposed throughout the structure. The rigid blocks 15 of the stopping can be made from conventional materials, such as, e.g., cinder, slag, and gravel aggregates combined with sand and cement, with or without mortar between the joints 17 of adjoining rigid blocks. The block stoppings of the invention which have conventionally mortared joints where the concrete blocks abut on one another, such as at joint 17' between blocks 15' and 15'', are rigidly resistant to the compressive pressure and shock forces which can cause air leakage. The compliant material 16 can be positioned between the rigid blocks 16 in a random or nonrandom pattern. However, the compliant or compressible material 16 is preferentially interposed between the rigid masonry blocks in a substantially nonrandom manner, such as in the mine stopping arrangements illustrated in FIGS. 1 and 2.

Thus, material 16 preferably comprises a yielding, flame spread-resistant, gas flow-impervious material adapted to be interposed between mine surfaces and the non-yielding components 15 of the stopping 10 and between components 15 themselves to seal the stopping and to accommodate convergence loads imposed on it. The compliant material is conveniently installed in the shape of a board or slab which can be fabricated from carefully formulated materials such as polyisocyanurate or polyurethane polymeric foam, glass fibers, or other materials with similar physical characteristics. Material 16 may be of any alternative compliant or extrudable sealant material that satisfies Bureau of Mines requirements.

Figure 2:
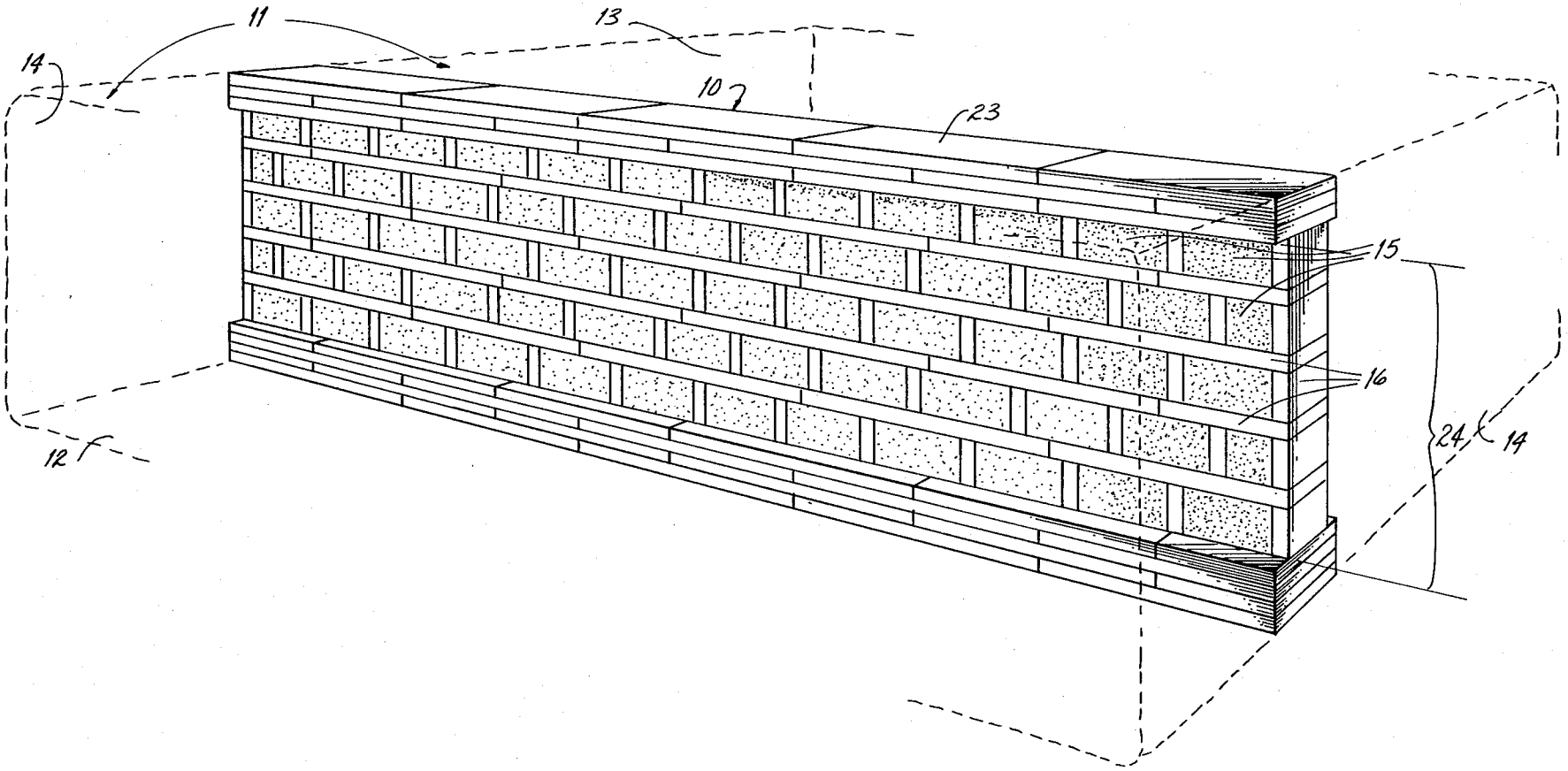
FIG. 2 is a perspective view similar to FIG. 1 but illustrating an alternative embodiment of the present invention.

In the embodiments of the invention illustrated in FIGS. 1 and 2, compliant material 16 advantageously comprises a foam plastic slab which forms a sealing and load absorbing layer at the perimeter of the stopping and also within the interior field of the stopping. It is also within the scope of the invention to use conventional sealing agents at the perimeter of the stopping and the compliant material only within its interior field. Closed-cell foam plastics capable of interfering with the passage of ventilation gases are suitable for implementing this invention. A preferred foam plastic material 16 is a board product made of glass fiber reinforced polyurethane or polyisocyanurate foam which may also be faced with metal sheets. These facers may be aluminum adhered to the face of a foam core during the process of manufacture, such as by the process described in U.S. Pat. No. 4,118,533. A highly suitable foam plastic for the masonry mine stoppings of the invention is a lightweight, glass fiber reinforced polyisocyanurate foam plastic board available from The Celotex Corporation of Tampa, Florida under the trademark MAX-SEAL. For ease of installation, the MAX-SEAL foam plastic can be supplied in convenient standard sizes, such as dimensions of 8 inches wide×48 inches long×4 inches thick, and 12 inches wide×48 inches long×4 inches thick. These boards are easily cut to other lengths as may be desired during installation into the mine stoppings of the invention.

The stopping construction shown in FIG. 1 is typically approximately 7 feet high by 20 feet wide. Construction of the stopping is suitably begun by positioning the compliant material, which advantageously is in the form of glass fiber reinforced closed cell polyisocyanurate foam boards 16, on the tunnel floor to form a lower perimeter seal 18. The foam boards used for the lower seal have a dimension a of 4 inches, a dimension b of 12 inches, and a dimension c of 48 inches. As shown in FIG. 1, the lower sealing boards are arranged in four layers, although a greater or lesser number of layers can be employed. Also, one or more layers can differ in thickness or composition from the other layers. The foam boards (five full boards) of the first or lowest layer are positioned in end-to-end abutting contact to extend from one side to the other of the tunnel opening, with the lower major surfaces of the boards contacting the mine tunnel floor. The boards of the next or second layer are placed on those of the first layer in similar end-to-end abutting contact across the tunnel opening. In the second layer, the boards are positioned so that the joints formed by the end-to-end contact are substantially staggered with respect to the joints in the first layer, with the lower major surfaces of the upper boards being in contact and coextensive with the upper major surfaces of the lower boards. The staggering is achieved by starting the second layer at one side of the tunnel with a board which has been cut so that it extends only half as far across the tunnel opening as the underlying board of the first layer, and continuing thereafter with full boards to the other side where the layer is completed utilizing another cut board. The remaining two layers of boards at the lower perimeter of the stopping are similarly arranged so that joints are staggered between adjacent layers. This is accomplished by positioning the boards of the third and fourth layers to have joints substantially in line with the joints in the first and second layers, respectively.

The middle section 19 of stopping 10 comprises a plurality of concrete blocks 15 and foam boards 16 which together form a wall built on the lower four sealing layers of the stopping. This section is made using for the most part concrete blocks typically having a dimension×of 8 inches, a dimension y of 8 inches, and a dimension z of 16 inches. As illustrated in FIG. 1, a number of smaller concrete blocks are located at or near the two side edges of the middle section of the stopping. Interposed at various locations between blocks 15 are foam boards 16, which are employed in two sizes, viz., 4 in.×8 in.×8 in. and 4 in.×8 in.×48 in.

In the construction of middle section 19 of the stopping, a course of the blocks 15 is first laid on the top layer of lower seal 18. At spaced points along this first course of blocks 15 there are provided 4 in.×8 in.×8 in. boards 16 as sealing and cushioning members between adjacent blocks of the course. Except for where the side walls of the tunnel interrupt the arrangement, the course is assembled to have a repeating pattern consisting of two or more concrete blocks in side-by-side contact separated by a foam board 16 from another set of two or more adjoining blocks, the latter set separated by another board 16 from the next set of blocks in line, and so forth over the course. The blocks and boards of the first course are positioned so that the joints in this course are substantially staggered with respect to the joints in the underlying layer of foam boards. A second course of blocks 15 and 4 in.×8 in.×8 in. boards 16 is laid on top of the aforementioned first course in a repeating pattern like that of the first course. The blocks 15 and boards 16 of the second course are positioned so that the joints formed by placing the blocks and boards in side-by-side position are substantially staggered with respect to the joints in the first course. A layer 20 of 4 in.×8 in.×48 in. boards 16 next is placed so that the boards are in end-to-end contact on top of the second course of blocks and boards, with the joints between adjoining boards staggered with respect to the joints in the underlying second course.

As can be seen in FIG. 1, the middle section 19 of the stopping is completed by positioning on foam board layer 20 third and fourth courses of blocks 15 and interposed boards 16, which may have the same arrangement as the first and second courses, respectively, of the middle section, and by then locating another foam board layer 21, which is arranged like lower layer 20, on top of the fourth course of blocks and boards, followed by placing on top of layer 21 fifth and sixth courses of blocks and interposed boards, which also are arranged in the same manner as the first and second courses, respectively, of the middle section.

Three foam board layers are located on top of the sixth or upper course of blocks and boards of the middle section and between this course and the mine ceiling 13 to form the upper perimeter seal 22 of the stopping of the invention. The same staggering technique applied in building the lower seal and middle section of the stopping is followed in the formation of the upper seal. Additionally, the same size foam boards are preferentially utilized in constructing this upper seal as in the construction of the lower seal. Since the dimension b (12 inches) of the foam boards used in the upper and lower perimeter seal layer is greater than the corresponding dimension (8 inches) of the middle section of the stopping, during the process of construction the middle section should be appropriately centered on the underlying lower seal and in turn the upper seal should be centered on the middle section, as shown in FIG. 1.

In the process of installing the stopping of the invention, it is important that a tight sealing engagement be achieved between the stopping and the surrounding surfaces of the tunnel floor, walls and roof. Irregularities in the tunnel profile can complicate the problem of perfecting these seals. To fill gaps between the stopping and mine surfaces, cement plaster, cement mortar, flame spread-resistant polymeric foam or other conventional and U.S. Bureau of Mines accepted sealing agents can be used around the stopping perimeter. Air leakage through the stopping itself can be reduced in various ways. Impervious films and coatings, such as rigid spray foam, formulated latex emulsions, plasters or paints, may be sprayed, troweled or otherwise applied directly onto the higher air pressure face of the stopping to form an air-tight covering membrane thereover. Additionally, the stopping can be constructed utilizing mortar-laid materials. However, stoppings built of dry stacked materials, i.e., without mortar in the joints, also are within the scope of the invention.

The mine stopping 23 of the invention illustrated in FIG. 2 is designed for utilization where the degree of convergence and heaving in a mine are especially severe. While the upper and lower perimeter seals of stopping 23 are like the upper and lower seals of above-described stopping 10, and the same staggering technique is utilized in both stoppings, the middle sections of the two stoppings are different. The middle section 19 of stopping 10 has a plurality of adjacent concrete blocks in surface-to-surface contact, including abutting blocks located in the same course and in adjoining courses. On the other hand, there is no contact between any of the concrete blocks of the middle section 24 of stopping 23, since foam boards 16 are arranged to form a complete perimeter seal around each concrete block 15 of the section. As shown in FIG. 2, this sealing arrangement is achieved by separating each block 15 of a given course of section 24 from each next adjacent block 15 of the course by a board 16, and by separating each course of blocks and interposed boards from each next adjacent course of the section by a layer of end-to-end abutting boards 16. Additionally, foam boards 16 are seen to provide a seal around the entire perimeter of stopping 23. The type of construction illustrated in FIG. 2 is very advantageous because each rigid block is completely surrounded and hence cushioned by compliant material, thereby enhancing the capacity of the stopping for yielding to extreme compressive forces caused by roof sagging and floor heaving in the mine while still retaining its control over ventilating air flow.

The present invention provides a mine stopping with a novel compliance capability to respond to varied compressive forces caused by strata convergence in a mine tunnel. Convergence loading stress on the all-masonry stoppings of the prior art causes an arching effect within the stopping and results in both laterally and vertically imposed crushing loads on the concrete blocks of the stopping. This arching effect also opens joints between the concrete blocks, causing severe air leakage to occur well before complete structural failure of the stopping. While the conventional all-masonry stoppings have been modified to include header boards, wedges and other materials, including polystyrene foam blocks, as perimeter sealing members, it has been found that these prior art constructions do not allow lateral relief against early open joint or structural failure caused by the induced arching from convergence loading. It has now been discovered that the compressible sealing material of the invention, when properly applied intermediately to the horizontal and vertical joints of the block field area to complement similarly compliant material at the top and bottom perimeter of the stopping, allows both lateral and vertical flexibility to relieve the induced arching or convexing of the stopping from convergence loading. As a result, the stopping of the invention is capable of resisting air leakage failure significantly longer than a conventional non-compliant "all-masonry" stopping.

Whereas the present invention has been described with respect to specific embodiments thereof, it should be understood that the invention is not limited thereto as many modifications thereof may be made. It is, therefore, contemplated to cover by the present application any and all such modifications as fall within the true spirit and scope of the appended claims.

We claim:

1. A stopping for use in improving underground mine ventilation comprising an assembly of wall elements, said wall elements comprising:

(a) a plurality of rigid non-yielding components, and (b) a plurality of compliant sealing members, the sealing members being composed of flame spread-resistant and gas flow-impervious material, the rigid components and sealing members being arranged in courses which extend from one side to the other of a tunnel opening and from the floor to the ceiling of the opening to form a wall which extends over substantially the entire cross section of the opening being stopped, the sealing members being positioned at the top and bottom perimeters of the wall and between the rigid components so as to (i) accommodate convergence loads imposed on the wall, and (ii) form, together with the rigid components, a barrier against the flow of gas through the tunnel.

2. The stopping of claim 1 wherein the joints formed between adjacent wall elements of each course are staggered with relation to the joints formed between adjacent wall elements of each adjacent course.

3. The stopping of claim 2 wherein the compliant sealing members comprise slabs of foam plastic.

4. The stopping of claim 3 wherein the slabs of foam plastic are reinforced by glass fibers.

5. The stopping of claim 4 wherein the slabs are faced with aluminum sheets.

6. The stopping of claim 1 wherein compliant sealing members are positioned so that each rigid non-yielding component of the wall is completely surrounded by compliant sealing members.

7. The stopping of claim 6 wherein the joints formed between adjacent wall elements of each course are staggered with relation to the joints formed between adjacent wall elements of each adjacent course.

8. The stopping of claim 7 wherein the compliant sealing members comprise slabs of foam plastic.

9. The stopping of claim 8 wherein the slabs of foam plastic are reinforced by glass fibers.

10. The stopping of claim 1 wherein the rigid non-yielding components comprise concrete blocks, and the compliant sealing members comprise foam plastic slabs.

11. The stopping of claim 10 wherein the joints formed between adjacent wall elements of each course are staggered with relation to the joints formed between adjacent wall elements of each adjacent course.

12. The stopping of claim 10 wherein foam plastic slabs are positioned so that each concrete block of the wall is completely surrounded by foam plastic slabs.

13. The stopping of claim 1 wherein the compliant sealing members comprise slabs of foam plastic.

14. The stopping of claim 13 wherein the foam plastic is polyurethane foam.

15. The stopping of claim 13 wherein the foam plastic is polyisocyanurate foam.

16. The stopping of claim 13 wherein the slabs of foam plastic are reinforced by glass fibers.

17. The stopping of claim 16 wherein the foam plastic is polyisocyanurate foam.

18. The stopping of claim 6 wherein the compliant sealing members comprise slabs of foam plastic.

19. The stopping of claim 18 wherein the foam plastic is polyurethane foam.

20. The stopping of claim 18 wherein the foam plastic is polyisocyanurate foam.

21. The stopping of claim 18 wherein the slabs of foam plastic are reinforced by glass fibers.

22. The stopping of claim 21 wherein the foam plastic is polyisocyanurate foam.

23. The stopping of claim 10 wherein the foam plastic is polyurethane foam.

24. The stopping of claim 10 wherein the foam plastic is polyisocyanurate foam.

25. The stopping of claim 10 wherein the slabs of foam plastic are reinforced by glass fibers.

26. The stopping of claim 25 wherein the foam plastic is polyisocyanurate foam.

* * * * *